US006733346B2

(12) United States Patent
Tsuji et al.

(10) Patent No.: US 6,733,346 B2
(45) Date of Patent: May 11, 2004

(54) TERMINAL FITTING, A CONNECTOR PROVIDED THEREWITH AND A METHOD FOR FORMING A TERMINAL FITTING

(75) Inventors: Takeshi Tsuji, Yokkaichi (JP); Hideto Nakamura, Yokkaichi (JP); Ryotaro Ishikawa, Yokkaichi (JP); Hajime Kawase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 30 days.

(21) Appl. No.: 10/234,295

(22) Filed: Sep. 3, 2002

(65) Prior Publication Data

US 2003/0049975 A1 Mar. 13, 2003

(30) Foreign Application Priority Data

Sep. 7, 2001 (JP) ..... 2001-272453

(51) Int. Cl.[7] ..... H01R 13/432
(52) U.S. Cl. ..... 439/748; 439/746
(58) Field of Search ..... 439/746, 748, 439/749

(56) References Cited

U.S. PATENT DOCUMENTS 5,362,260 A * 11/1994 Peloza ..... 439/746
5,620,345 A * 4/1997 Macioce et al. ..... 439/746
5,766,025 A * 6/1998 Davis ..... 439/660
5,879,196 A * 3/1999 Lee ..... 439/660
5,993,268 A * 11/1999 Yamaguchi ..... 439/752.5
6,186,837 B1 * 2/2001 Abe ..... 439/748
6,227,915 B1 5/2001 Sakatani et al. ..... 439/852
6,238,252 B1 * 5/2001 Flieger ..... 439/746
6,280,234 B1 8/2001 Yamamoto et al. ..... 439/456
6,280,261 B1 * 8/2001 Sakurai ..... 439/746
6,368,165 B2 * 4/2002 Kubo ..... 439/752

FOREIGN PATENT DOCUMENTS

FR 2 769 413 4/1999

* cited by examiner

*Primary Examiner*—Hung V. Ngo
(74) *Attorney, Agent, or Firm*—Gerald E. Hespos; Anthony J. Casella

(57) ABSTRACT

A terminal fitting (30) has a substantially box-shaped main body (31) with a base plate (36), first and second side plates (37, 38) projecting from the base plate (36), and outer and inner projecting plates (39, 40) projecting from the side plates (37, 38). The outer projecting plate (39) has a recess (50) for receiving a lock when the terminal fitting (30) is inserted into a cavity of a housing. The recess (50) is rectangular and an opening edge thereof is continuous over the entire periphery. A holding piece (51) projects from an edge of the inner projecting plate (40) and fits into the recess (50) for keeping the box shape of the main portion (31).

14 Claims, 11 Drawing Sheets

TERMINAL FITTING, A CONNECTOR PROVIDED THEREWITH AND A METHOD FOR FORMING A TERMINAL FITTING

BACKGROUND OF THE INVENTION

1. Field of the Invention

The invention relates to a terminal fitting, to a connector with a terminal fitting and to a method for forming a terminal fitting.

2. Description of the Related Art

U.S. Pat. No. 6,280,234 and FIG. 12 herein disclose a terminal fitting that has a base plate 1 extending in forward and backward directions. Side plates 2, 3 stand from the opposite lateral edges of the base plate 1, and projecting plates 4, 5 project from the side plates 2, 3. The projecting plates 4, 5 are bent and placed one outside the other. Thus the base plate 1, the side plates 2, 3 and the projecting plates 4, 5 define a box-shaped main body 6. The center of the outer projecting plate 5 is cut away over a specified length to form a recess 7 and to define front and rear portions 5*a* and 5*b* forward and rearward of the recess 7. Holding pieces 8 project from the projecting edges of front and rear portions 5*a* and 5*b* of the projecting plate 5 and engage with holding holes 9 formed in the left side plate 2 in FIG. 12 to keep the main portion 6 box-shaped.

The terminal fitting of FIG. 12 is inserted into a housing that has a recess and a lock configured for engaging the recess 7. A design change may occur for the housing that accommodates the above-described terminal fitting. For example, if the lock is shifted forward, the recess 7 of the terminal fitting needs to be formed more forward than in FIG. 12 to correspond to the changed position of the lock. However, a sufficient length cannot be ensured for the front holding piece 8 if an attempt is made to shift the position of the recess 7 more forward than a specified position. In other words, the position of the recess 7 is restricted by the holding pieces 8.

The present invention was developed in view of the above problem and an object thereof is to improve a degree of freedom in setting the position of an engaging recess.

SUMMARY OF THE INVENTION

The invention is directed to a terminal fitting with a substantially box-shaped main body that has a base plate and first and second side plates that extend from opposite lateral sides of the base plate. First and second projecting plates project from the respective side plates and are bent to be placed one outside the other. A holding piece is provided on at least one of the projecting plates and fits into a hole in the main body to maintain the main body in a specified shape. An engaging recess is formed in the outer projecting plate for receiving a lock of a housing when the terminal fitting is inserted into the housing. The engaging recess is spaced longitudinally from the holding piece, so that the edge near the holding piece is continuous in the longitudinal direction of the main body.

The engaging recess does not divide the holding piece, and therefore the holding piece can have a sufficient length. Furthermore, there is improved freedom in setting the position of the holding piece, and the position of the engaging recess can be set substantially independently of the holding piece. Thus, even if the position of the lock is shifted, for example, due to a design change of the housing, such a shift can be accommodated easily.

The engaging recess preferably has an opening edge that defines a continuous periphery that is spaced from the edge of the respective projecting plate. As a result, the engaging recess is strong.

The engaging recess may also function as the holding hole. Thus, the terminal fitting can be simpler and stronger.

The invention also is directed to a connector with a housing that has at least one cavity into which the above-described terminal fitting can be inserted. The housing has a lock that can be inserted into the engaging recess of the terminal fitting.

The invention also relates to a method for forming a terminal fitting. The method comprises forming a sheet material to define a base plate, first and second side plates that extend from the base plate, and first and second projecting plates that project from the respective side plates. The method comprises bending the side plates to extend up from the base plate and bending the projecting plates over another to define a main body. The method also comprises forming at least one holding piece on at least one of the projecting plates and forming a holding hole opposed to the holding piece. The method then comprises fitting the holding piece into the holding hole for maintaining the main body in a specified shape. The method further comprises forming an engaging recess in the outer projecting plate at a location spaced longitudinally from the holding piece so that the edge that has the holding piece is continuous in the longitudinal direction of the main body.

The main body may be formed to have a substantially box shape.

The engaging recess preferably is formed such that an opening edge of the engaging recess is continuous over the entire periphery.

The engaging recess also preferably is formed to be continuous with the holding hole.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
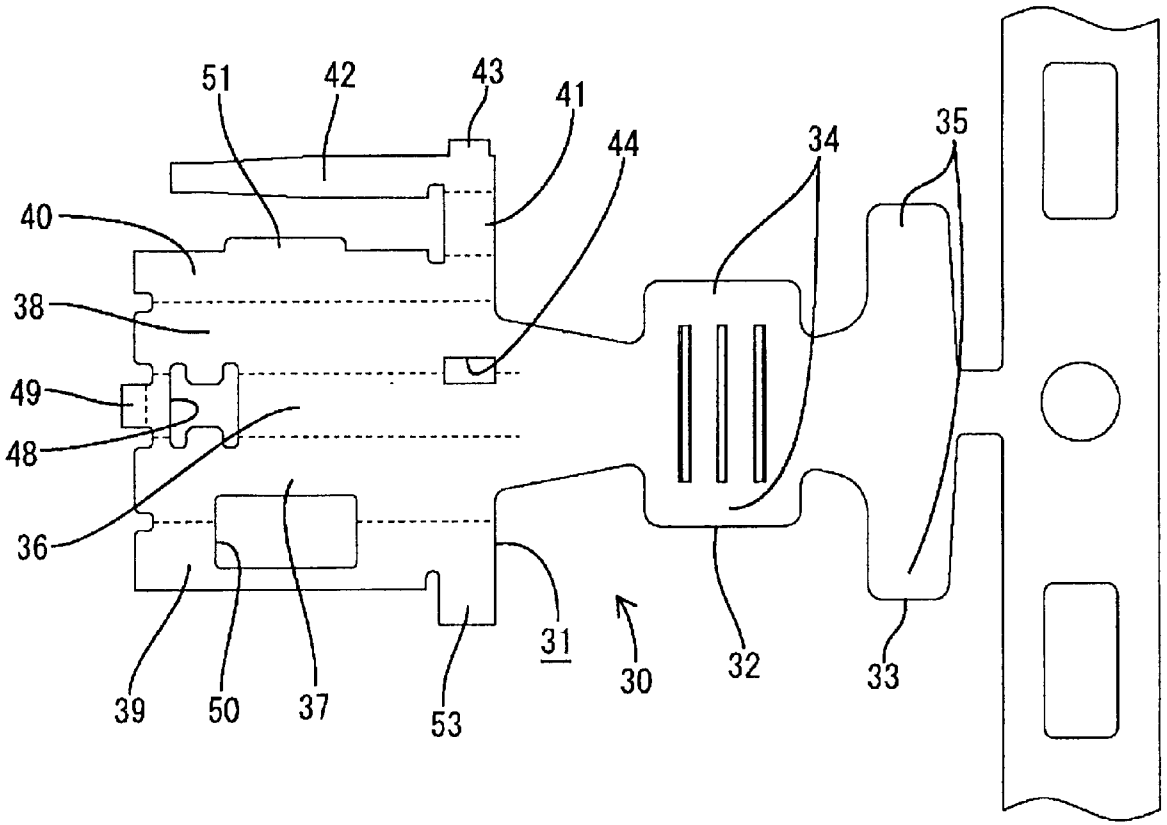
FIG. 1 is a blank of sheet material used to form a terminal fitting according to a first embodiment of the present invention.

A first embodiment of the invention is described with reference to FIGS. 1 to 10. In this embodiment, female terminal fittings are inserted into a female housing. The inserting direction of the terminal fittings into the housing is referred to as the forward direction in the following description.

A female housing according to the invention is identified by the numeral 10 in FIGS. 6–10. The housing 10 is made e.g. of a synthetic resin, and has internal cavities 11 arranged in two stages. The housing 10 also has a retainer mount hole 12 for receiving a retainer 21 from below. The retainer mount hole 12 intersects a bottom wall 13 of each cavity 11 and divides the bottom wall 13 into a front piece and a rear piece. Resiliently deflectable locks 14 are formed by cutting a portion of the bottom wall 13 of each cavity 11 before the retainer mount hole 12. Each lock 14 is comprised of an arm 15 with supported front and rear ends and a locking section 16 substantially at the center of the upper surface of the arm 15.

Terminal fittings 30, as shown in FIGS. 2 to 5, are configured for insertion into the cavities 11 of the housing 10. Each terminal fitting 30 is formed by stamping a metallic plate into a blank, as shown in FIG. 1, and bending, embossing, cutting, folding and/or press-forming the stamped-out piece. The front end of the terminal fitting 30 includes a main body 31 that is electrically connectable with an unillustrated male terminal fitting. A wire barrel 32 is disposed rearward of the main body 31 and is configured to be crimped, bent or folded into connection with an exposed core at an end of a wire W. An insulation barrel 33 is at the rear end of the terminal fitting and is configured to be crimped, bent or folded into connection with an insulated portion of the wire W. The wire barrel 32 is comprised of a pair of crimping pieces 34, and the insulation barrel 33 is comprised of a pair of crimping pieces 35.

Figure 2:
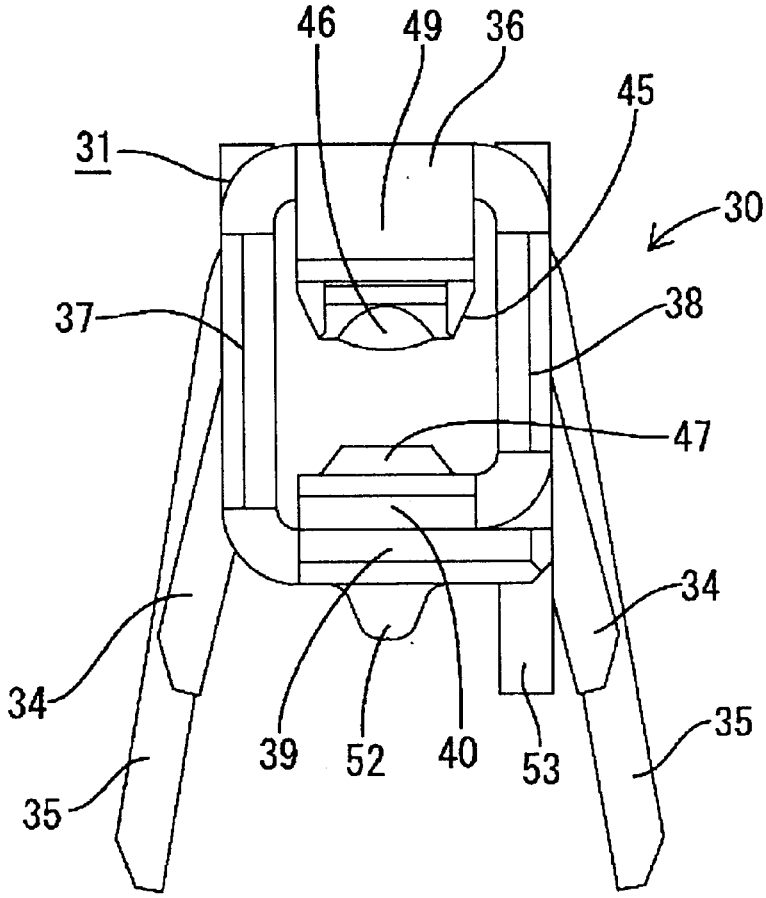
FIG. 2 is a front view of the terminal fitting.
Figure 7:
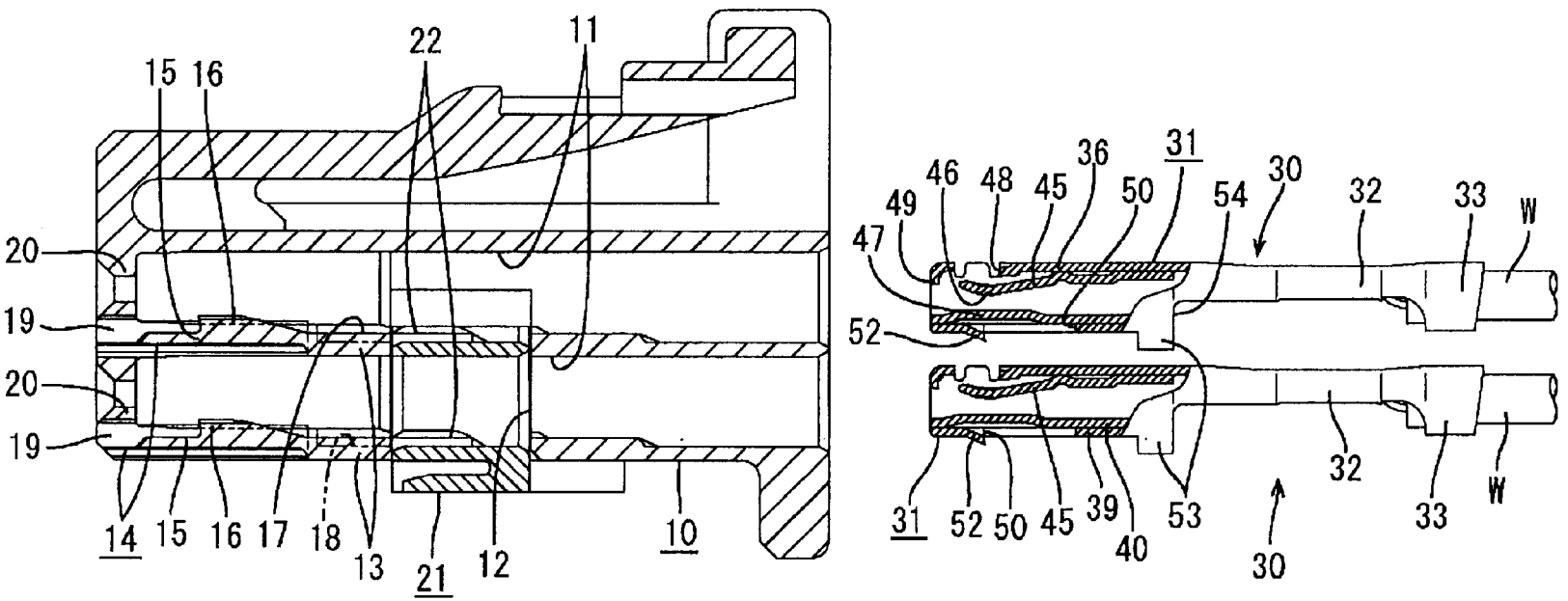
FIG. 7 is a side view in section showing a state where the retainer is mounted at a partial locking position in the housing before the terminal fittings are inserted.

The main body 31 is a substantially rectangular box that is open forward and backward as shown in FIG. 2. More particularly, the main body 31 has a base plate 31 and first and second side plates 37, 38 that project orthogonally from opposite lateral edges of the base plate 36. Outer and inner projecting plates 39 and 40 project respectively from the first and second side plates 37 and 38, and are aligned substantially parallel to the base plate 36. The outer projecting plate 39 is disposed outwardly from and in substantially face-to-face engagement with the inner projecting plate 40. A tongue 42 extends longitudinally forward and backward and is coupled to the second inner plate 40 via a coupling piece 41. The coupling piece 41 is bent twice during the formation of the main body 31 to extend along the inner surfaces of the first side plate 37 and the base plate 36. The tongue 42 extends forward along the inner surface of the base plate 36, and defines a cantilevered resilient contact 45, as shown in FIG. 7. An inserting piece 43 projects from the coupling piece 41, as shown in FIG. 1, and is inserted into an insertion hole 44 in the side plate 38 (see FIG. 4) to position the resilient contact 45 longitudinally. As shown in FIG. 7, the resilient contact 45 has an inwardly projecting front portion that is spaced away from the base plate 36 and that is deformable upwardly. The contact piece 45 also has contact portion 46 that can resiliently contact a male terminal fitting (not shown) inserted into the main body 31 from the front. A bulge 47 projects in from a portion of the inner projecting plate 40 that faces the resilient contact piece 45 for enhancing contact pressure with the male terminal fitting. A hole 48 is open upwardly at a portion of the base plate 36 that faces the front of the resilient contact piece 45. A protection piece 49 extends up from the front end of the base plate 36 to substantially the same height as the front end of the resilient contact piece 45. The protection piece 49 prevents the male terminal fitting (not shown) from being inserted between the base plate 36 and the projecting end of the resilient contact piece 45 and hence protects the resilient contact piece 45.

Figure 3:
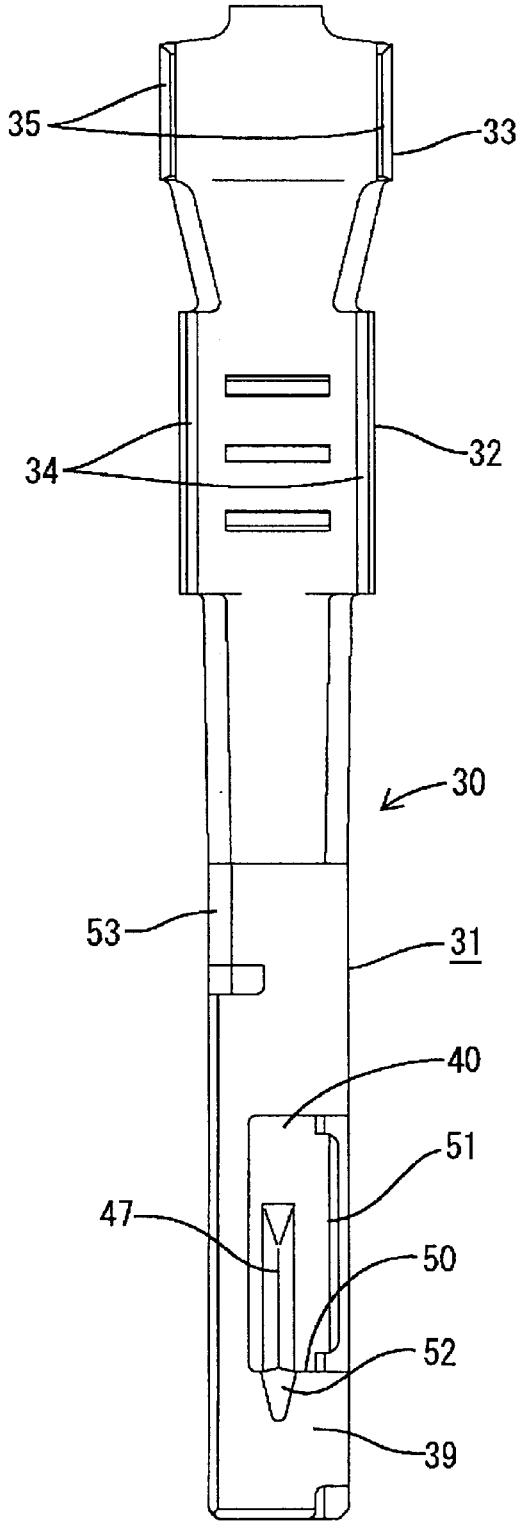
FIG. 3 is a bottom view of the terminal fitting.
Figure 5:
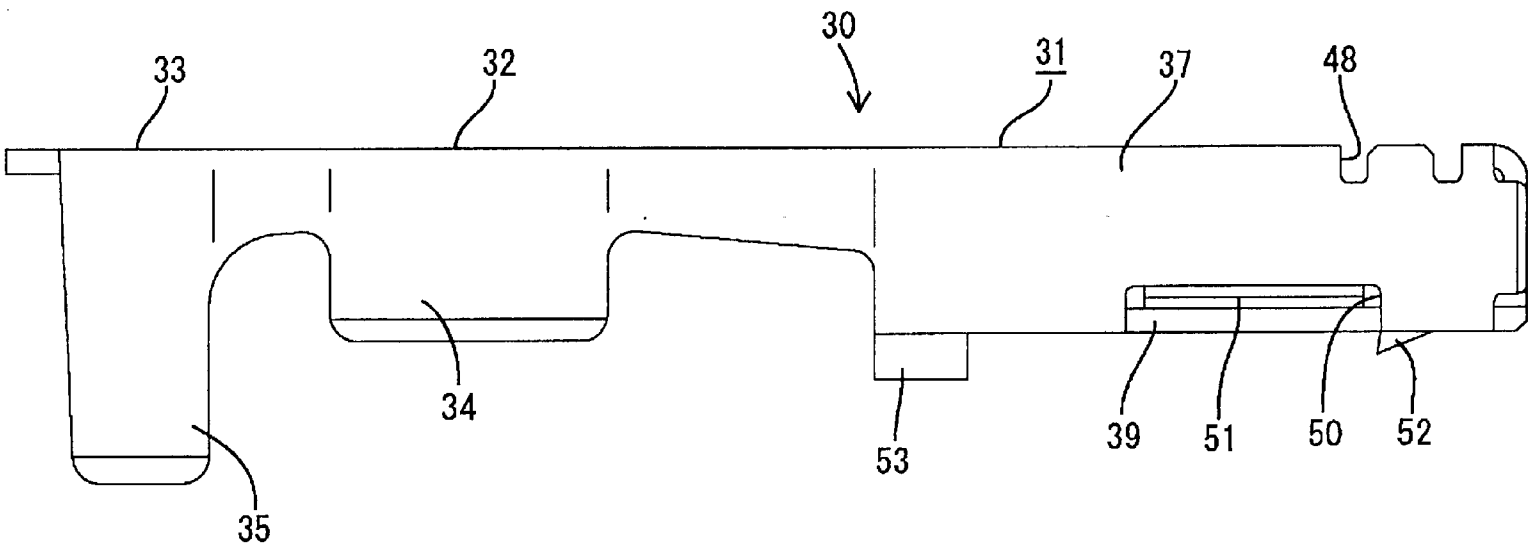
FIG. 5 is a left side view of the terminal fitting.

A substantially rectangular recess 50 is formed by cutting away portions of the outer projecting plate 39 and the first side plate 37 at a location forward of the longitudinal center of the projecting plate 39, as shown in FIG. 1. The recess 50 is spaced from the free longitudinal edge of the outer projecting plate 39. Thus, the peripheral edge of the recess 50 is continuous and defines a substantially rectangular shape. A holding piece 51 projects from the free longitudinal edge of the inner projecting plate 40 at a location aligned with the recess 50 and is slightly shorter than the recess 50. The holding piece 51 fits into the portion of the recess 50 in the first side plate 37 when the projecting plates 39, 40 are placed one over the other during the formation of the main body 31. Thus, as shown in FIGS. 3 and 5, the holding piece 51 and part of the bulge 47 on the inner projecting plate 40 are exposed to the outside through the recess 50. The engagement of the holding piece 51 with the recess 50 keeps the main body 31 substantially box-shaped.

Figure 4:
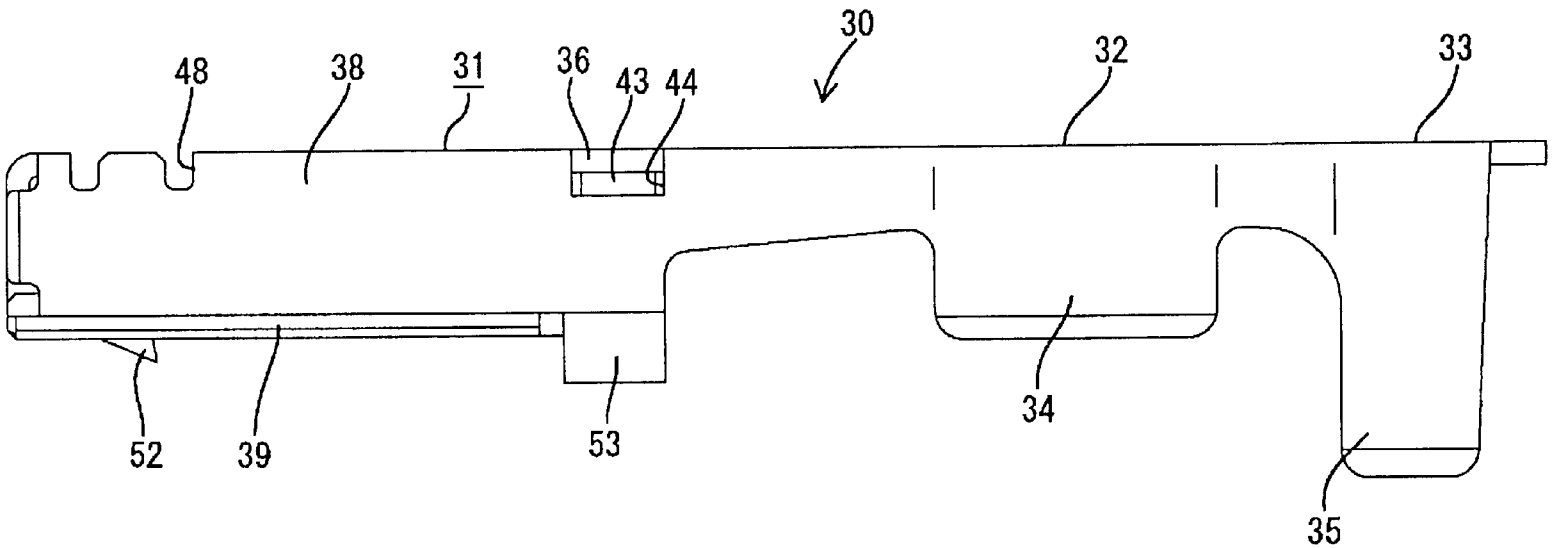
FIG. 4 is a right side view of the terminal fitting.

A projection 52 is embossed at the front edge of the recess 50, as shown in FIG. 7, for engaging the locking section 16 of the lock 14. The projection 52 is tapered toward the front end when viewed from below, as shown in FIG. 3, and is pointed substantially at the widthwise center of the main body 31 when viewed from front, as shown in FIG. 2. A stabilizer 53 projects from the rear end of the outer projecting plate 39, as shown in FIG. 4, and is bent to project at a right angle down from the main body 31 along the second side plate 38. Further, a jaw 54 is formed at the rear end of the main body 31 and is engageable with a locking projection 22 on the retainer 21.

Figure 8:
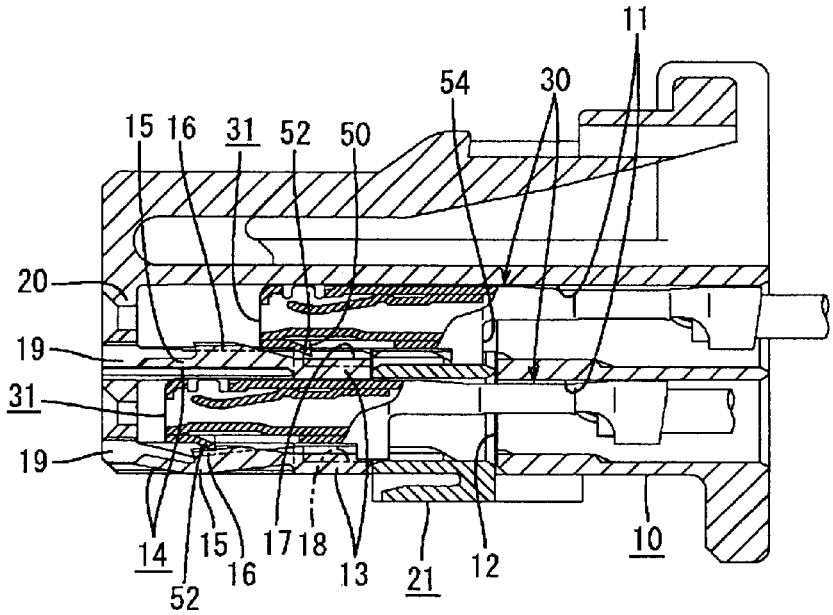
FIG. 8 is a side view in section showing intermediate stages of insertion of the terminal fittings.

The retainer 21 can be mounted at a partial locking position in the housing 10 so that the locking projections 22 are retracted from the cavities 11. The terminal fitting 30 then is inserted into the cavity 11 from behind, as shown in FIG. 7. This insertion brings the projection 52 into sliding contact with a projection insertion recess 17 formed in the center of the bottom surface of the cavity 11, and brings the stabilizer 53 into sliding contact with a stabilizer insertion recess 18 formed at a lateral edge of the bottom surface of the cavity 11. As a result, the inserting operation is guided smoothly. The lower front of the terminal fitting 30 presses the slanted rear surface of the locking section 16 of the lock 14 when the terminal fitting 30 reaches a specified depth, as shown in FIG. 8. As a result, the arm 15 is deflected resiliently down away from the cavity 11. The front and rear ends of the arms 15 are deformation supporting points. As a result, the arm 15 is deformed into a substantially arch shape in which the longitudinal center if the arm 15 is at a bottommost position.

Figure 9:
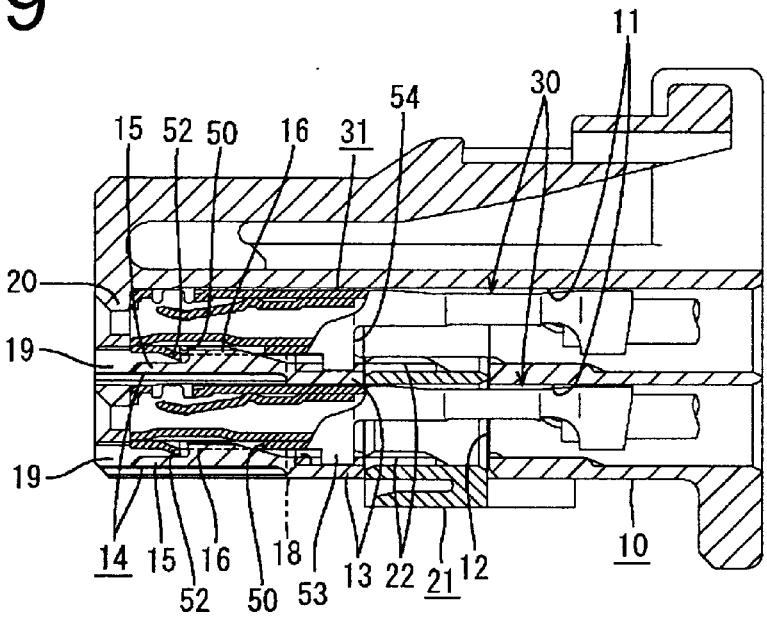
FIG. 9 is a side view in section showing a state where the terminal fittings are partly locked by locking portions.
Figure 10:
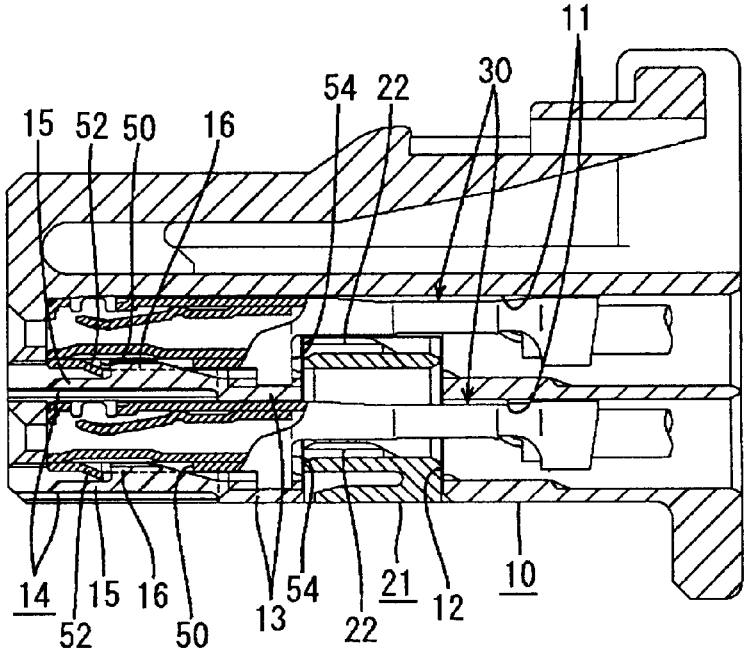
FIG. 10 is a side view in section showing a state where the retainer reaches a full locking position to doubly lock the terminal fittings.

The arm 15 is restored resiliently when the terminal fitting 30 is inserted to a proper depth and the locking section 16 enters the recess 50, as shown in FIG. 9. Thus, the locking section 16 engages the projection 52 at the front edge of the recess 50 for partly locking the terminal fitting 30 in the cavity 11. The retainer 21 then is moved up to a full locking position, as shown in FIG. 10, so that the locking projections 22 enter the cavities 11. As a result, the locking projections 22 engage the jaws 54 of the terminal fittings 30 and doubly lock the terminal fittings 30 in the cavities 11.

Circumstances may require a reduction in the force for inserting the terminal fitting 30 into the cavity 11, and hence a design change may be necessary. The force needed to deform the lock 14 significantly affects the force of inserting the terminal fitting 30. Thus, the designer may consider changing the structure of the lock 14 to reduce the terminal insertion force.

Figure 6:
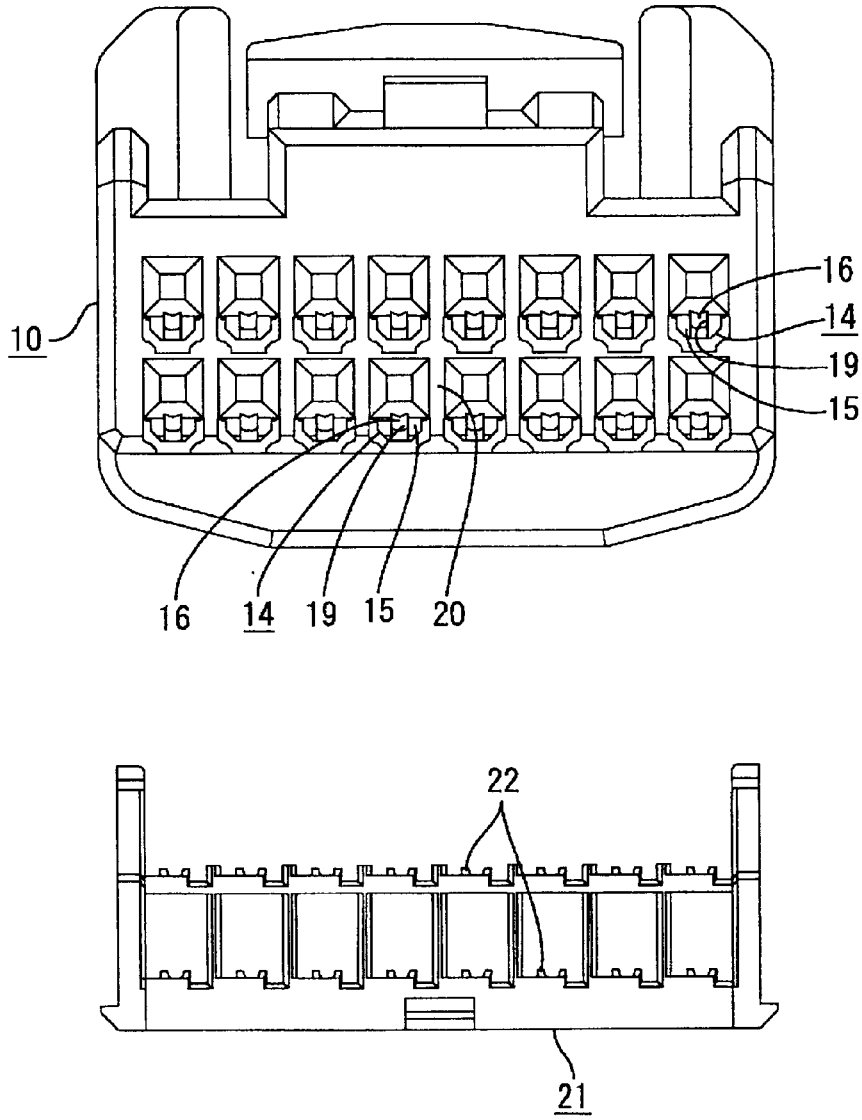
FIG. 6 is a front view of a housing and a retainer.

As shown in FIGS. 6 and 7, the arm 15 of each lock 14 has it rear end portion coupled to the bottom wall 13 of the cavity 11 over the entire width and has its front end formed into a fork shape because a mold-removal hole 19 is formed substantially in a middle to remove a mold forwardly. The remaining opposite sides of the arm 15 are coupled to the front wall 20 of the cavity 11. Accordingly, the distance between the rear support of the arm 15 and the point where the terminal fitting 30 presses the locking section 16 mainly determines the force necessary to deform the lock 14. Thus, a smaller force is necessary as this distance becomes longer. On the other hand, the locking force on the terminal fitting 30 is proportional to the length of the locking section 16, and it is necessary to ensure at least a minimum length for the locking section 16. Thus, the force to insert the terminal fitting 30 and to deform the lock 14 can be reduced by shifting the locking section 16 forward while ensuring the necessary minimum length for the locking section 16.

The recess 50 of the terminal fitting 30 must be moved forward if the locking section 16 of the lock 14 is moved forward. The recess 50 and the holding piece 51 are on the separate projecting plates 39, 40. Additionally, the recess 50 is spaced away from the edge of the inner projecting plate 40 where the holding piece 51 projects, as shown in FIG. 1. Accordingly, even if the recess 50 is shifted forward, the edge of the inner projecting plate 40 where the holding piece 51 projects is continuous in the longitudinal direction of the main body 31 independently of the recess 50 and a sufficient length can be ensured for the holding piece 51. Thus, a degree of freedom in setting the position of the recess 50 in the outer projecting plate 39 can be improved, and a forward shifting of the locking section 16 of the lock 14 can be accommodated easily. As a result, the force of inserting the terminal fitting 30 in the female connector can be reduced.

The recess 50 has a continuous periphery. Accordingly, the outer projecting plate 39 is continuous in the longitudinal direction of the main body 31, and is stronger. Furthermore, the recess 50 also functions as a holding hole for engaging the holding piece 51. Therefore, the terminal fitting 30 has a simpler construction and more strength as compared to a case where the holding hole is formed separately in the main body 31.

A second embodiment of the invention is described with reference to FIG. 11. Although the recess 50 and the holding piece 51 are provided on separate projecting plates in the first embodiment, they are provided on the same projecting plate in the second embodiment.

Figure 11:
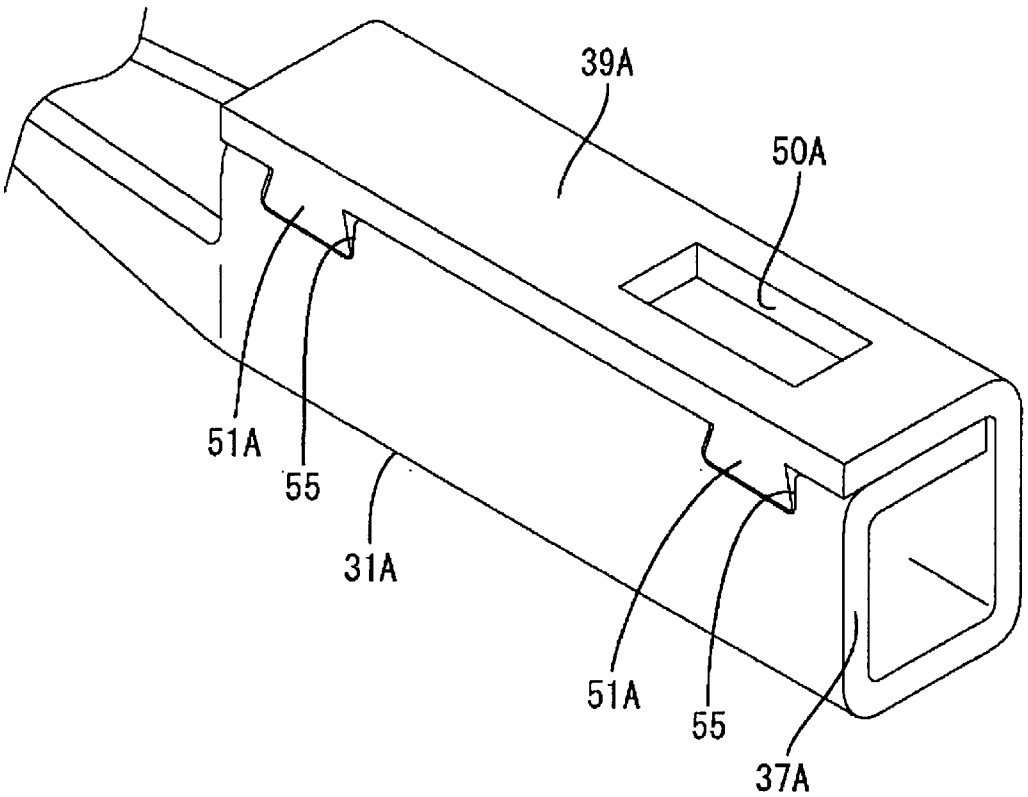
FIG. 11 is a perspective view of a terminal fitting according to a second embodiment of the invention.
Figure 12:
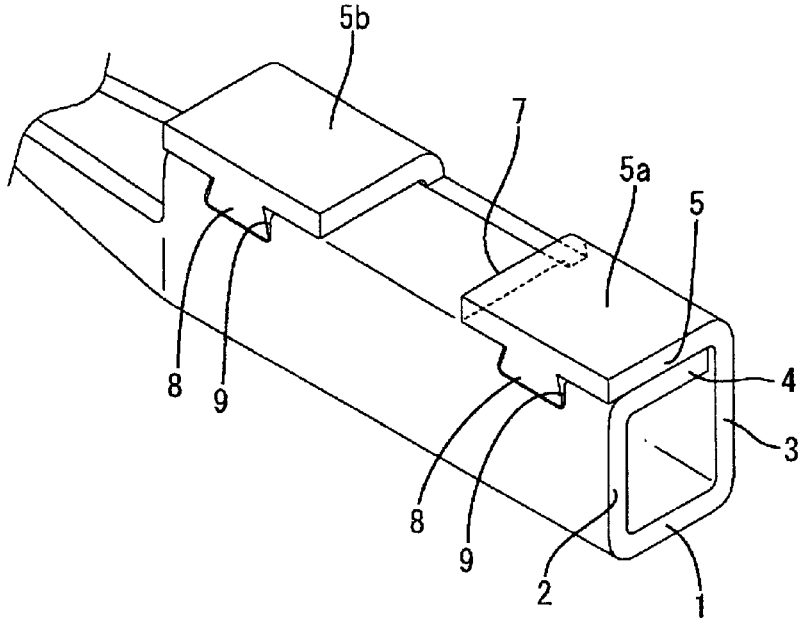
FIG. 12 PRIOR ART
FIG. 12 is a perspective view of a prior art terminal fitting.

As shown in FIG. 11, a substantially rectangular recess 50A is formed on an outer projecting plate 39A and has an opening edge that defines a continuous rectangular periphery. Front and rear holding pieces 51A project from the free edge of the outer projecting plate 39A, and fit into holding holes 55 in the side plate 37A for keeping the box shape of the main body 31. The recess 50A is spaced from the free edge of the outer projecting plate 39A. Thus, the holding pieces 51A can have a sufficient length without being divided by the recess 50A. In addition, the recess 50A can be positioned independently of the holding pieces 51A. Thus, the holding piece 51A and the recess 50A can overlap along forward and backward directions, as shown in FIG. 11. Therefore, a shift of the position of the locking section 16 of the lock 14 caused by the design change of the connector can be dealt with easily.

No repetitive description is given on the other construction, functions and effects because they are same as in the first embodiment.

The invention is not limited to the above described and illustrated embodiments. For example, the following embodiments also are embraced by the technical scope of the present invention as defined by the claims. Beside the following embodiments, various changes can be made without departing from the scope and spirit of the present invention as defined by the claims.

The recess has a continuous periphery in the first embodiment. However, the recess may open to the free edge of the outer projecting plate in embodiments where the holding piece is on the inner projecting plate.

The invention is also applicable to male terminal fittings in which a tab projects forward from a substantially box-shaped main body.

The terminal fittings are insertable into a housing with a lock that has both ends supported in the foregoing embodiments. However, the invention also is also applicable to a housing with locks supported only at one end.

What is claimed is:

1. A terminal fitting (30), comprising:

a main body (31; 31A) with a base plate (36), first and second side plates (37, 38; 37A) extending from the base plate (36), and outer and inner projecting plates (39, 40; 39A) projecting from the respective first and second side plates (37, 38; 37A), the outer projecting plate (39; 39A) having a longitudinal edge;

at least one holding piece (51; 51A) on at least one of the projecting plates (39, 40; 39A) and engaged in at least one holding hole (50; 55) for keeping the main body (31; 31A) in a specified shape; and an engaging recess (50; 55) formed in the outer projecting plate (39; 39A) at a location spaced from the longitudinal edge of the outer projecting plate (39; 39A), such that the longitudinal edge of the outer projecting plate (39; 39A) is continuous in a longitudinal direction of the main body (31; 31A).

2. The terminal fitting of claim 1, wherein main body (31; 31A) is substantially box-shaped.

3. The terminal fitting of claim 2, wherein the side plates (37, 38; 37A) extend from the opposite lateral edges of the base plate (36).

4. The terminal fitting of claim 3, wherein the engaging recess (50; 55) has a continuous peripheral edge.

5. The terminal fitting of claim 1, wherein the holding hole (50) is part of the engaging recess (50).

6. The terminal fitting of claim 1, wherein the holding piece (51A) is on the outer projecting plate (39A) and the holding hole (55) is formed in the second side plate (39).

7. The terminal fitting of claim 6, wherein the at least one holding piece (51A) comprises a plurality of holding pieces (51A), one of said of holding pieces (51A) being disposed longitudinally to at least partly align with the engaging recess (50A).

8. The terminal fitting of claim 6, wherein the holding piece (51A) is bent at substantially a right angle to the outer projecting (39A).

9. The terminal fitting of claim 1, wherein the holding hole (50) is continuous with the engaging recess (50) and extends from the outer projecting plate (39) onto part of the first side plate (37), the holding piece (51) extending from the second side plate (51).

10. A connector comprising:

a housing (10) having at least one cavity (11) with a resiliently deflectable lock (14); and at least one terminal fitting (30) configured for insertion into the cavity (11), the terminal fitting (30) having a main body (31; 31A) with a base plate (36), first and second side plates (37, 38; 37A) extending from the base plate (36), and outer and inner projecting plates (39, 40; 39A) projecting from the respective first and second side plates (37, 38; 37A), the outer projecting plate (39; 39A) having a longitudinal edge, at least one holding piece (51; 51A) on at least one of the projecting plates (39, 40; 39A) and engaged in at least one holding hole (50; 55) for keeping the main body (31; 31A) in a specified shape, and an engaging recess (50; 55) formed in the outer projecting plate (39; 39A), the engaging recess (50; 55) being spaced from the longitudinal edge of the outer projecting plate (39; 39A), such that the longitudinal edge of the outer projecting plate (39; 39A) is continuous in a longitudinal direction of the main body (31; 31A) the recess being disposed and dimensioned for engagement by the lock (14) when the terminal fitting (30) is inserted into the cavity (11).

11. A method for forming a terminal fitting (30), comprising:

forming a metal blank with a base plate (36), first and second side plates (37, 38; 37A) extending from opposite sides of the base plate (36), and first and second projecting plates (39, 40; 39A) extending from sides of the respective first and second side plates (37, 38; 37A) opposite the base plate (36), the first holding plate (39; 39A) having an edge opposite the first side plate (37; 37A);

forming at least one holding piece (51; 51A) on at least one of the projecting plates (39, 40; 39A) and forming at least one holding hole (50; 55) at a location alignable with the holding piece (51; 51A);

forming an engaging recess (50; 55) in the first projecting plate (39; 39A) at a position spaced from the edge of the first projecting plate (39; 39A), such that the edge is continuous;

bending the side plates (37, 38; 37A) relative to the base plate (36) and bending the projecting plates (39, 40; 39A) relative to the side plates (37, 38; 37A) to be a placed one (39; 39A) outside the other (40); and inserting the holding piece (51; 51A) into the holding hole (50; 55) for maintaining a specified shape for a main body (31) of the terminal fitting (30).

12. The method of claim 11, wherein the main body (31; 31A) has a substantially box-shape.

13. The method of claim 12, wherein the side plates (37, 38; 37A) are bent to extend from the opposite lateral edges of the base plate (36).

14. The method according of claim 11, wherein the engaging recess (50) is formed to be continuous with the holding hole (50).

* * * * *